US006050882A

United States Patent [19]

Chen

[11] Patent Number: 6,050,882

[45] Date of Patent: Apr. 18, 2000

[54] CARRIER HEAD TO APPLY PRESSURE TO AND RETAIN A SUBSTRATE

[75] Inventor: Hung Chih Chen, San Jose, Calif.

[73] Assignee: Applied Materials, Inc., Santa Clara, Calif.

[21] Appl. No.: 09/330,243

[22] Filed: Jun. 10, 1999

[51] Int. Cl.[7] ..... B24B 5/00

[52] U.S. Cl. ..... 451/41; 451/285; 451/288; 451/398

[58] Field of Search ..... 451/41, 285, 287, 451/288, 385, 397, 398

[56] References Cited

U.S. PATENT DOCUMENTS

| | | | |
|---|---|---|---|
| 5,662,518 | 9/1997 | James et al. | 451/41 |
| 5,730,642 | 3/1998 | Sandhu et al. | 451/41 |
| 5,733,182 | 3/1998 | Muramatsu et al. | 451/289 |
| 5,888,120 | 3/1999 | Doran | 451/41 |

*Primary Examiner*—Eileen P. Morgan
*Attorney, Agent, or Firm*—Fish & Richardson

[57] ABSTRACT

A carrier head for a chemical mechanical polishing apparatus has a plurality of independently movable rods. The rods both apply pressure a substrate and surround the substrate to provide a retainer.

15 Claims, 4 Drawing Sheets

CARRIER HEAD TO APPLY PRESSURE TO AND RETAIN A SUBSTRATE

BACKGROUND

The present invention relates generally to chemical mechanical polishing of substrates, and more particularly to a carrier head for chemical mechanical polishing.

Integrated circuits are typically formed on substrates, particularly silicon wafers, by the sequential deposition of conductive, semiconductive or insulative layers. After each layer is deposited, it is etched to create circuitry features. As a series of layers are sequentially deposited and etched, the outer or uppermost surface of the substrate, i.e., the exposed surface of the substrate, becomes increasingly nonplanar. This nonplanar surface presents problems in the photolithographic steps of the integrated circuit fabrication process. Therefore, there is a need to periodically planarize the substrate surface.

Chemical mechanical polishing (CMP) is one accepted method of planarization. This planarization method typically requires that the substrate be mounted on a carrier or polishing head. The exposed surface of the substrate is placed against a polishing surface, e.g., a rotating polishing pad. The polishing pad may be either a "standard" or a fixed-abrasive pad. A standard polishing pad has a durable roughened surface, whereas a fixed-abrasive pad has abrasive particles held in a containment media. A polishing slurry, including at least one chemically-reactive agent, and abrasive particles, if a standard pad is used, is supplied to the surface of the polishing pad. The carrier head provides a controllable load, i.e., pressure, on the substrate to push it against the polishing pad. Some carrier heads include a flexible membrane that provides a mounting surface for the substrate, and a retaining ring to hold the substrate beneath the mounting surface. Pressurization or evacuation of a chamber behind the flexible membrane controls the load on the substrate.

The effectiveness of a CMP process may be measured by its polishing rate, and by the resulting finish (absence of small-scale roughness) and flatness (absence of large-scale topography) of the substrate surface. The polishing rate, finish and flatness are determined by the pad and slurry combination, the relative speed between the substrate and pad, and the force pressing the substrate against the pad.

SUMMARY

In one aspect, the invention is directed to a carrier head. The carrier head has a housing, a plurality of substantially independently movable rods, and a first chamber located between the rods and the housing. The chamber is pressurizable to force the rods into contact with a substrate and to surround the substrate to retain the substrate beneath the housing.

Implementations of the invention may include the following features. A lower boundary of the first chamber may be defined by a flexible membrane attached to the housing, and the rods may be attached to the flexible membrane. Alternately, the first chamber may apply pressure directly to the rods. The rods may have a circular or hexagonal cross-section, a longitudinal dimension of about 0.06 to 0.5 inches, and a cross-sectional dimension of about 0.03 to 0.25 inches. The longitudinal dimension of the rods may be about twice their cross-sectional dimension. The rods may be spaced apart by about 0.0005 to 0.005 inches. The rods may be positioned around a perimeter portion of the substrate during polishing, and the carrier head further may include a flexible membrane having a mounting surface to contact a central region of the substrate. A second chamber that is pressurizable to apply a load to the central region of the substrate may be located between the flexible membrane and the housing. The rods may be positioned substantially parallel to each other.

In another aspect, the invention is directed to a carrier head to hold a substrate on a polishing surface. The carrier head has a housing defining a chamber, a flexible membrane defining a lower boundary of said chamber, and a bundle of independently movable rods secured to the flexible membrane. When a pressure within the chamber is increased, the rods and move into contact with the substrate and the polishing surface to apply a force to the substrate and retain the substrate substantially beneath the housing.

In another aspect, the invention is directed to a method of polishing a substrate. In the method, a substrate is positioned between a polishing surface and a plurality of independently movable rods of a carrier head, and a pressure is applied to the plurality of rods. One group of rods contacts a back surface of the substrate, and a second group of rods contacts the polishing surface to surround the substrate to retain the substrate beneath the carrier head.

Advantages of the invention may include the following. The spacing between the retainer and the substrate can be reduced, thereby improving polishing uniformity near the edge of the substrate. The carrier head has a large tolerance for misalignment of the substrate at a loading station. The carrier head is also usable with substrates of different sizes and geometries.

Other advantages and features of the invention will be apparent from the following description, including the drawings and claims.

BRIEF DESCRIPTION OF THE DRAWINGS

Like reference numbers are designated in the various drawings to indicate like elements. A reference number with a prime or double-prime indicates that an element has a modified function, operation or structure.

DETAILED DESCRIPTION

Figure 1:
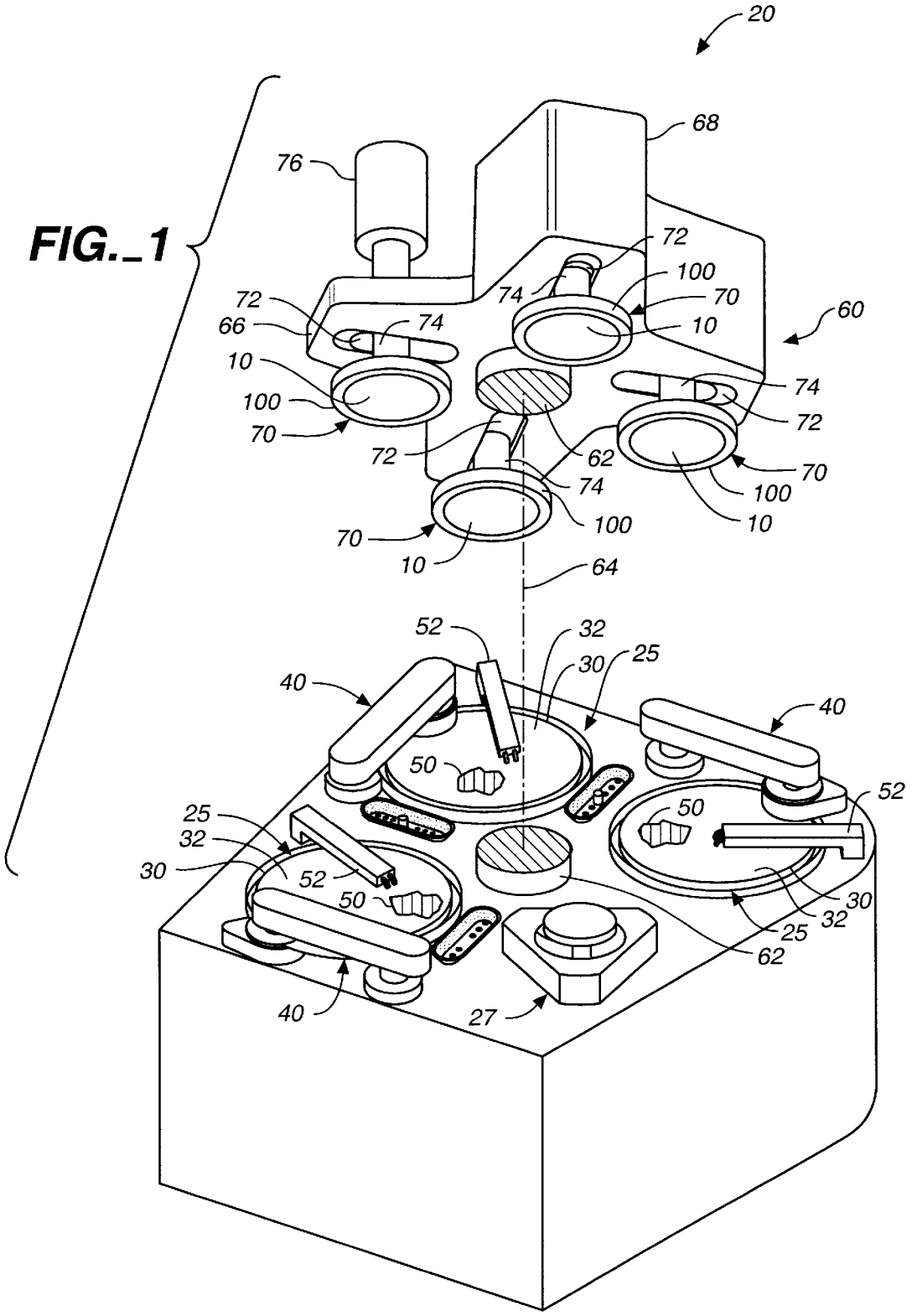
FIG. 1 is an exploded perspective view of a chemical mechanical polishing apparatus.

Referring to FIG. 1, one or more substrates 10 will be polished by a chemical mechanical polishing (CMP) apparatus 20. A description of a similar CMP apparatus may be found in U.S. Pat. No. 5,738,574, the entire disclosure of which is incorporated herein by reference.

The CMP apparatus 20 includes a series of polishing stations 25 and a transfer station 27 for the loading and unloading of the substrates. Each polishing station 25 includes a rotatable platen 30 on which is placed a polishing pad 32. If substrate 10 is an eight-inch (200 millimeter) or twelve-inch (300 millimeter) diameter disk, then platen 30 and polishing pad 32 will be about twenty or thirty inches in diameter, respectively. Platen 30 and polishing pad 32 may also be about twenty inches in diameter if substrate 10 is a six-inch (150 millimeter) diameter disk. For most polishing processes, a platen drive motor (not shown) rotates platen 30 at thirty to two-hundred revolutions per minute, although lower or higher rotational speeds may be used. Each polishing station 25 may further include an associated pad conditioner apparatus 40 to maintain the abrasive condition of the polishing pad.

A slurry 50 containing a reactive agent (e.g., deionized water for oxide polishing) and a chemically-reactive catalyzer (e.g., potassium hydroxide for oxide polishing) may be supplied to the surface of polishing pad 32 by a combined slurry/rinse arm 52. If polishing pad 32 is a standard pad, slurry 50 may also include abrasive particles (e.g., silicon dioxide for oxide polishing). Typically, sufficient slurry is provided to cover and wet the entire polishing pad 32. Slurry/rinse arm 52 includes several spray nozzles (not shown) which provide a high pressure rinse of polishing pad 32 at the end of each polishing and conditioning cycle.

A rotatable multi-head carousel 60 is supported by a center post 62 and rotated thereon about a carousel axis 64 by a carousel motor assembly (not shown). Multi-head carousel 60 includes four carrier head systems 70 mounted on a carousel support plate 66 at equal angular intervals about carousel axis 64. Three of the carrier head systems position substrates over the polishing stations. One of the carrier head systems receives a substrate from and delivers the substrate to the transfer station. The carousel motor may orbit carrier head systems 70, and the substrates attached thereto, about carousel axis 64 between the polishing stations and the transfer station.

Each carrier head system 70 includes a polishing or carrier head 100. Each carrier head 100 independently rotates about its own axis, and independently laterally oscillates in a radial slot 72 formed in carousel support plate 66. A carrier drive shaft 74 extends through slot 72 to connect a carrier head rotation motor 76 (shown by the removal of one-quarter of a carousel cover 68) to carrier head 100. There is one carrier drive shaft and motor for each head. Each motor and drive shaft may be supported on a slider (not shown) which can be linearly driven along the slot by a radial drive motor to laterally oscillate the carrier head.

During actual polishing, three of the carrier heads, are positioned at and above the three polishing stations. Each carrier head 100 lowers a substrate into contact with a polishing pad 32. Generally, carrier head 100 holds the substrate in position against the polishing pad and distributes a force across the back surface of the substrate. The carrier head also transfers torque from the drive shaft to the substrate.

Figure 2:
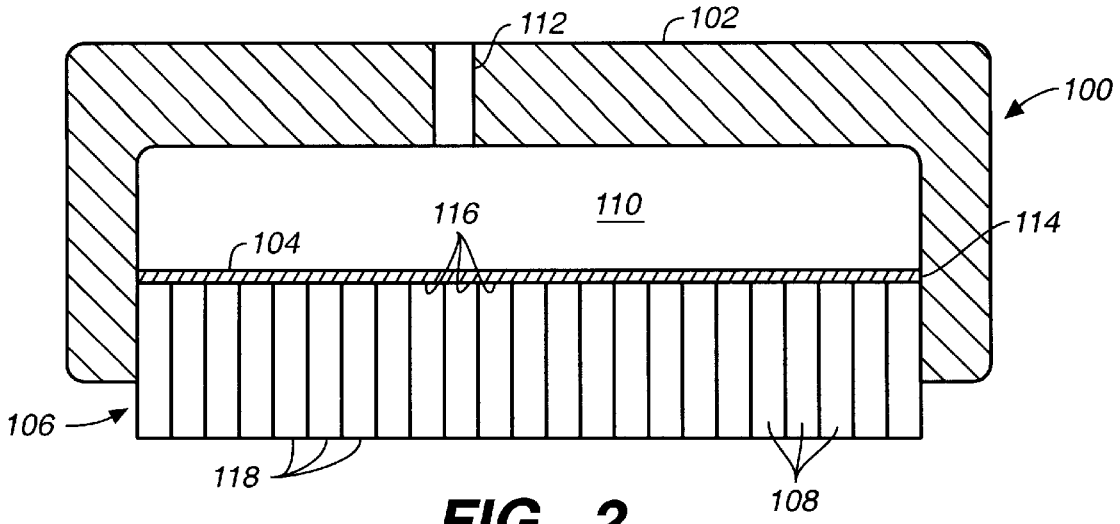
FIG. 2 is a schematic cross-sectional view of a carrier head according to the present invention.

Referring to FIGS. 2, carrier head 100 includes a housing 102, a rod-backing membrane 104 secured to the housing, and an array or bundle 106 of independently vertically-movable rods 108 attached to the underside of the membrane.

Housing 102 can be connected to drive shaft 74 to rotate therewith during polishing about an axis of rotation which is substantially perpendicular to the surface of the polishing pad during polishing. Housing 102 may be generally circular in shape to correspond to the circular configuration of the substrate to be polished. A vertical passage 112 may be formed through the housing to provide pneumatic control of the carrier head. Unillustrated O-rings may be used to form a fluid-tight seal between the passage through the housing and a corresponding passage through the drive shaft. Fluid coupling between the drive shaft and carrier head is discussed in pending U.S. application Ser. No. 08/861,260, filed May 21, assigned to the assignee of the present application, the entire disclosure of which is incorporated herein by references.

Membrane 104 is a generally circular sheet formed of a flexible and elastic material, such as silicone. An edge 114 of membrane 104 can be secured to housing 102 to form a fluid-tight seal, e.g., by an unillustrated clamp, adhesive, or the like. The sealed volume between membrane 104 and housing 102 defines a loading chamber 110. Loading chamber 110 can be pressurized to apply a load, i.e., a downward pressure, to membrane 104 and thus to rods 108. A pump (not shown) may be fluidly connected to loading chamber 110 by passage 112 to control the pressure in the loading chamber and, thus, the load applied to the rods.

The rods 108 are attached to membrane 104, e.g., by an adhesive or mechanical fasteners, to form bundle 106. Specifically, the rods are arranged with their longitudinal axes generally parallel to each other and perpendicular to the plane of the polishing pad. The rods in bundle 106 are sufficiently densely packed that small gaps between individual rods do not affect the polishing uniformity, yet sufficiently loosely packed that the rods can slide vertically relative to each other. Furthermore, membrane 104 is sufficiently flexible that each rod can move vertically independently by at least the substrate thickness (about 27 mils for an "eight-inch" substrate). In short, the underside of bundle 106 formed by the bottom surfaces of the individual rods provides a collection of individually vertically adjustable surfaces.

Figure 3A:
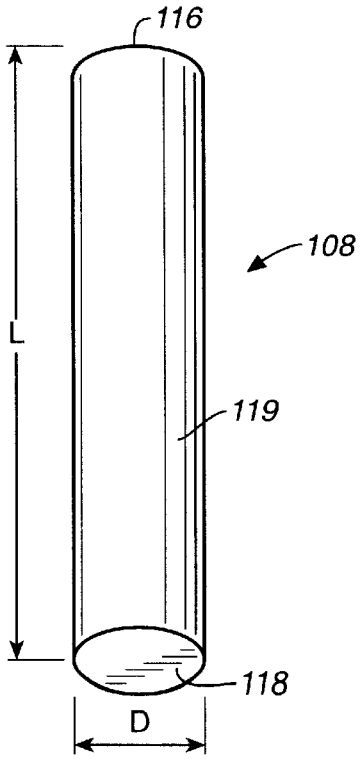
FIG. 3A is a perspective view of a rod having a circular cross-section.
Figure 3B:
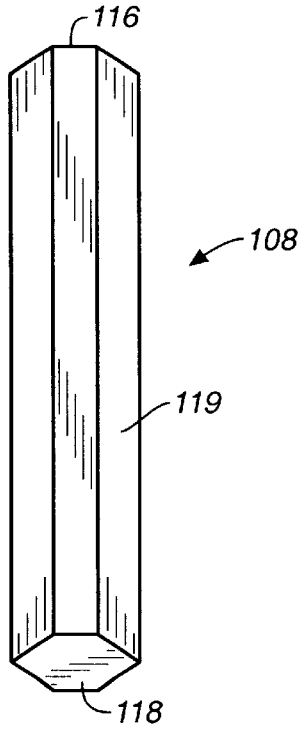
FIG. 3B is a perspective view of a rod having a hexagonal cross-section.

Referring to FIG. 3A, rods 108 may be elongated circular shafts formed of a low-friction material, such as Delrin™, available from DuPont of Newark, Delaware, or polyphenylene sulfide (PPS). Each rod has a top surface 116 that is adjacent the membrane, a bottom surface 118, and a side surface 119 that slides against the corresponding side surface of adjacent rods. As illustrated, rods 108 can have a circular cross-section, a longitudinal dimension L of about 0.06 to 0.5 inches, and a cross-sectional dimension D of about 0.03 to 0.25 inches. The longitudinal dimension of the rod should be about twice its cross-sectional dimension. Of course, the rods can have other cross-sectional shapes. For instance, they may be hexagonal (see FIG. 3B) or square.

Figure 4:
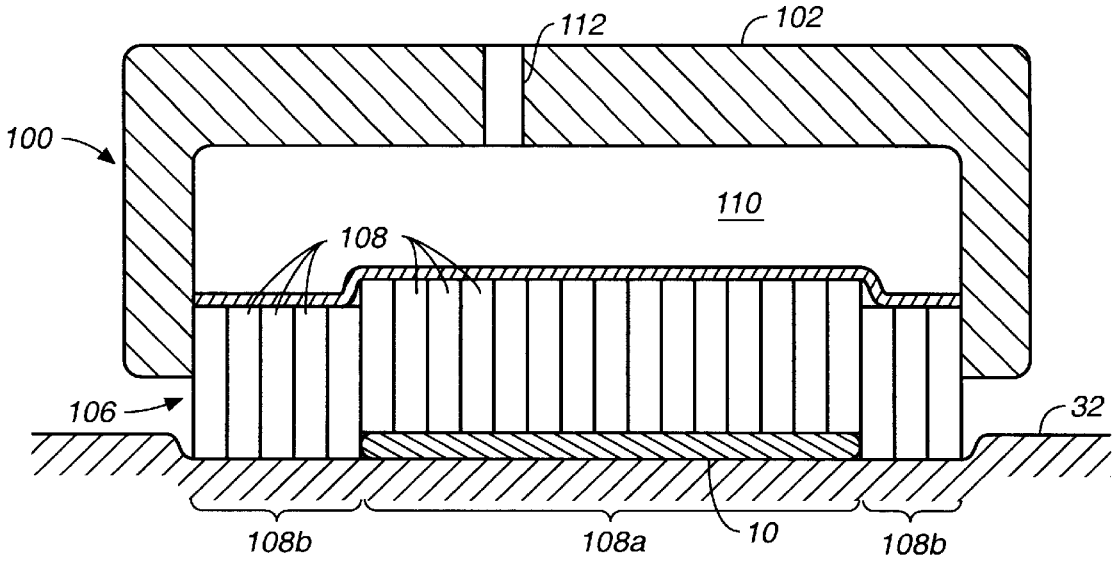
FIG. 4 is a schematic cross-sectional view of the carrier head of FIG. 2 being used to polish a substrate.
Figure 5:
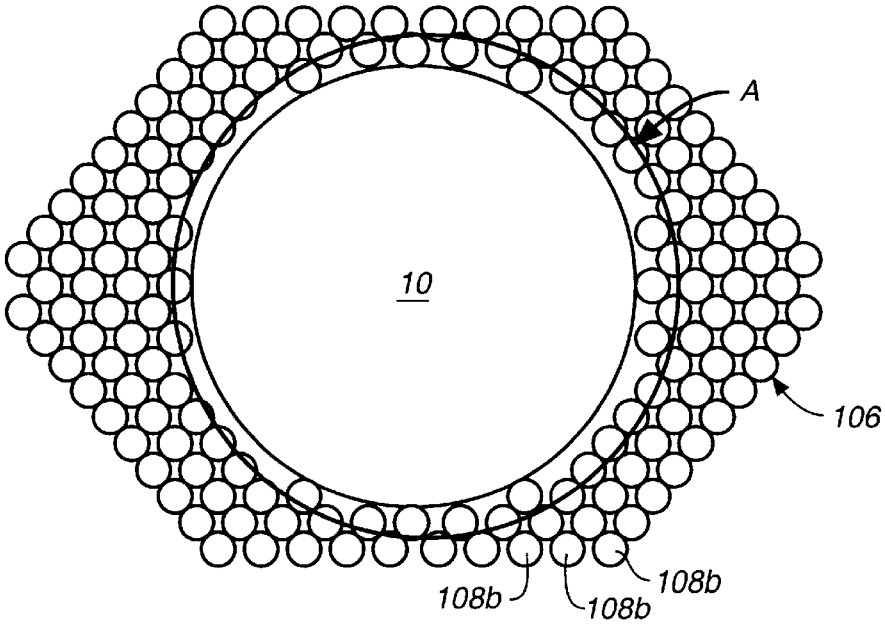
FIG. 5 is a schematic bottom view of the carrier head of FIG. 2 loaded with a substrate.

Referring to FIGS. 4 and 5, rod bundle 106 provides the functions of both a retaining ring and a substrate backing member. During polishing, substrate 10 is placed on polishing pad 32 beneath carrier head 100. Fluid is pumped into chamber 110 via passage 112 to force flexible membrane 118 and rods 108 downwardly. The rods 108*a* positioned above substrate 10 (which are obscured by the substrate in the view of FIG. 5) press against the backside of the substrate. However, the rods 108*b* positioned outside the region directly above the substrate are forced into contact the polishing pad and surround the substrate. During polishing, frictional forces from the polishing pad will force the substrate against the sides of the "innermost" rods 108*b*, i.e, the rods adjacent the substrate. Thus, the rod bundle both applies pressure and retains the substrate beneath the carrier head. The closer the "fit" between the rods and the substrate, the less room the polishing pad has to decompress, thereby providing improved polishing uniformity at the substrate edge.

As explained below, the cross-sectional shape and dimensions of the rods are selected to provide a small gap with the substrate while ensuring that the rods can slide relative to each other. It should be noted that the greater the frictional forces between the rods, the more likely it is that the rods will "stick" rather than slide. Three main factors contribute to these frictional forces and the fit of the rods to the substrate: the spacing between the rods, the cross-sectional dimension (D) of the rods, and the contact area between the side surfaces of adjacent rods.

With respect to the spacing between adjacent rods, which may be about 0.0005 to 0.005 inches, closely packed rods will provide smaller substrate gap and more uniform pressure profile, but exhibit a higher coefficient of friction. Conversely, loosely packed rods will exhibit a lower coefficient of friction, but will provide a wider substrate gap and a more nonuniform pressure profile.

With respect to the cross-sectional dimension (D) of the rods, decreasing this cross-sectional dimension will increase the rod density, thereby improving the substrate fit. However, since the surface area of the a rod's side surface scales linearly to D, whereas the surface area of a rod's top surface scales to the square of D, decreasing the cross-sectional dimension will increase the frictional forces relative to the pressure on the rod. Conversely, increasing the cross-sectional dimension will result in a worse fit to the substrate, but will decrease the frictional forces.

The contact area between the side surfaces of the rods also depends on their cross-sectional shape. For example, circular rods will contact each other only along a relatively narrow strip, whereas hexagonal or square rods will contact each other across the entire face of the rod. Using a cross-sectional shape that provides a larger contact area (e.g., by using a hexagonal rod instead of a circular rod) will improve the substrate fit, but will also increase the frictional forces. Conversely, decreasing the contact area of will result in a worse substrate fit, but will decrease the frictional forces. Circular rods may be used in a densely packed bundle to reduce the frictional forces, whereas hexagonal rods may be used in a loosely packed bundle to improve the substrate fit.

The rods that surround the substrate will be pressed into contact the polishing pad to form a retainer. Thus, the carrier head is self-fitting to substrates having different diameters and different geometries (e.g., flatted or notched wafers). Since the rods are self-fitting, it should be possible to significantly reduce the gap between the substrate and retainer edge as compared to a conventional retaining ring (shown by solid line A in FIG. 5). Furthermore, the carrier head has a large tolerance for misalignment of the substrate. When the substrate is loaded at the transfer station or at a polishing station, the rods will adjust to surround the substrate, regardless of its horizontal position. In addition, the pressure on the top surface of the rods will cause them to move downwardly as their bottom surfaces are worn away. Thus, the rod bundle provides a retainer that is less subject to uneven wear patterns.

Figure 6:
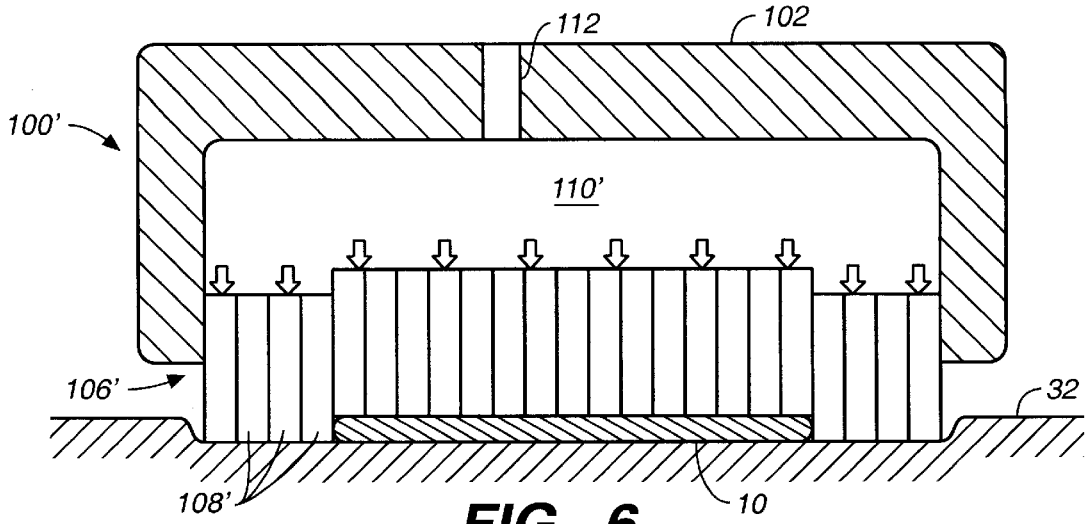
FIG. 6 is a schematic cross-sectional view of a carrier head in which the rods are not attached to a backing membrane.

Referring to FIG. 6, in another embodiment, carrier head 100' does not include a flexible membrane. Instead, pressure is applied directly to the top surfaces of rods 108'. When the carrier head is lifted away from the polishing pad, vacuum is applied to chamber 110' to hold the bundle in the carrier head. In this implementation, the vacuum source needs a sufficiently high flow rate to compensate for pressure leaks between the rods.

Figure 7:
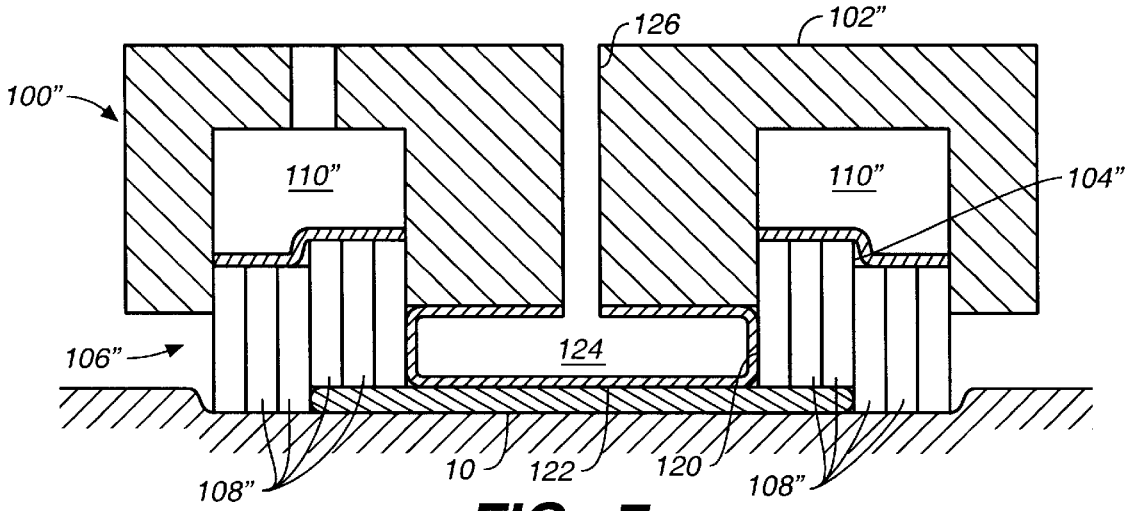
FIG. 7 is a schematic cross-sectional view of a carrier head that includes both rods and a substrate-backing membrane.

Referring to FIG. 7, in another embodiment, carrier head 100" includes both a flexible membrane 120 that contacts a back surface of the substrate, and a bundle 106" of rods 108". Specifically, rods 108" may be positioned in an annular region around membrane 120. A lower surface 122 of membrane 120 provides a mounting surface to apply pressure to a central region of the substrate. Rods 108" function as the retainer and apply pressure to a perimeter region of the substrate. The volume between rods 108" and housing 102" defines an annular first pressurizable chamber 110", and a first pump (not shown) may be fluidly connected to chamber 110" by passage 112" to control the pressure in the chamber and thus the downward force on rods 108". The sealed volume between flexible membrane 120 and housing 102" defines a second pressurizable chamber 124. A second pump (not shown) may be fluidly connected to chamber 124 by a passage 126 in housing 102" to control the pressure in chamber 124 and thus the downward force of flexible membrane 120 on the substrate. In addition, chamber 124 may be evacuated to pull flexible membrane 120 upwardly and thereby vacuum-chuck the substrate to the carrier head.

The present invention has been described in terms of a number of embodiments. The invention, however, is not limited to the embodiments depicted and described. Rather, the scope of the invention is defined by the appended claims.

What is claimed is:

1. A carrier head to hold a substrate on a polishing surface, comprising:

a housing;

a plurality of substantially independently movable rods; and a first chamber located between the rods and the housing, the chamber pressurizable to force the rods into contact with a substrate and to surround the substrate to retain the substrate beneath the housing.

2. The carrier head of claim 1, wherein a lower boundary of the first chamber is defined by a flexible membrane attached to the housing.

3. The carrier head of claim 2, wherein the rods are attached to the flexible membrane.

4. The carrier head of claim 2, wherein the first chamber applies pressure directly to the rods.

5. The carrier head of claim 1, wherein the rods have a circular cross-section.

6. The carrier head of claim 1, wherein the rods have a hexagonal cross-section.

7. The carrier head of claim 1, wherein the rods have a longitudinal dimension of about 0.06 to 0.5 inches.

8. The carrier head of claim 1, wherein the rods have a cross-sectional dimension of about 0.03 to 0.25 inches.

9. The carrier head of claim 1, wherein the rods have a longitudinal dimension of about twice their cross-sectional dimension.

10. The carrier head of claim 1, wherein the rods are spaced apart by about 0.0005 to 0.005 inches.

11. The carrier head of claim 1, wherein the rods are positioned around a perimeter portion of the substrate during polishing, and the carrier head further comprises a flexible membrane having a mounting surface to contact a central region of the substrate.

12. The carrier head of claim 11, further comprising a second chamber located between the flexible membrane and the housing, the second chamber being pressurizable to apply a load to the central region of the substrate.

13. The carrier head of claim 1, wherein the rods are positioned substantially parallel to each other.

14. A carrier head to hold a substrate on a polishing surface, comprising:

a housing defining a chamber;

a flexible membrane defining a lower boundary of said chamber; and a bundle of independently movable rods secured to the flexible membrane such that when a pressure within the chamber is increased, the rods move into contact with the substrate and the polishing surface to apply a force to the substrate and surround the substrate to retain the substrate substantially beneath the housing.

15. A method of polishing a substrate, comprising:

positioning a substrate between a polishing surface and a plurality of independently movable rods of a carrier head; and applying a pressure to the plurality of rods so that one group of rods contact a back surface of the substrate and a second group of rods contact the polishing surface to surround the substrate to retain the substrate beneath the carrier head.

* * * * *